US006659603B2

(12) United States Patent
Kida et al.

(10) Patent No.: US 6,659,603 B2
(45) **Date of Patent: *Dec. 9, 2003**

(54) INK JET RECORDING METHOD AND APPARATUS HAVING PLATEN WITH EXTRUSIONS POSITIONED IN ONE-TO-ONE CORRESPONDENCE WITH ROLLER NIPS

(75) Inventors: Akira Kida, Kawasaki (JP); Nozomu Nishiberi, Yokohama (JP); Toshiya Matsumoto, Yokohama (JP); Kazuo Ohyama, Mitaka (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/517,506

(22) Filed: Mar. 2, 2000

(65) Prior Publication Data

US 2002/0171727 A1 Nov. 21, 2002

(30) Foreign Application Priority Data

May 14, 1999 (JP) ..... 11-134205
May 14, 1999 (JP) ..... 11-134207
Feb. 28, 2000 (JP) ..... 2000-051579

(51) Int. Cl.[7] ..... B41J 2/01; B41J 13/10

(52) U.S. Cl. ..... 347/104; 400/636; 400/646; 271/188

(58) Field of Search ..... 347/104, 101; 400/636, 637, 637.4, 639, 636.3, 600.3, 642, 646; 271/249, 252, 188, 209

(56) References Cited

U.S. PATENT DOCUMENTS 5,326,011 A * 7/1994 Mager et al. ..... 226/181
5,531,436 A 7/1996 Ohyama et al.
5,700,099 A 12/1997 Kobayashi et al.
5,805,176 A 9/1998 Saito et al.
5,821,968 A 10/1998 Ohyama et al.
5,847,719 A 12/1998 Yamaguchi et al.
5,874,979 A 2/1999 Ohyama
5,877,783 A 3/1999 Iwasaki et al.
5,940,092 A 8/1999 Kashimura et al.
5,961,234 A * 10/1999 Uchikata ..... 400/636
6,027,211 A * 2/2000 Unosawa et al. ..... 347/104
6,113,289 A * 9/2000 Saito et al. ..... 400/58
6,250,731 B1 * 6/2001 Hasimoto ..... 347/8
6,273,624 B1 * 8/2001 Nishimura et al. ..... 400/637.1
6,457,888 B1 * 10/2002 Matsumoto ..... 400/625
2002/0186291 A1 * 12/2002 Kanazawa et al. ..... 347/104

FOREIGN PATENT DOCUMENTS

EP 0 699 537 3/1996
EP 0 795 413 9/1997
EP 0 728 589 A2 * 8/1998 ..... B41J/13/00
EP 0 922 587 6/1999
JP 61-95966 5/1986
JP 4-69264 3/1992
JP 9-48161 2/1997

* cited by examiner

*Primary Examiner*—Leslie J. Evanisko
(74) *Attorney, Agent, or Firm*—Fitzpatrick, Cella, Harper & Scinto

(57) ABSTRACT

An ink jet recording apparatus, which records with deposition of ink droplets onto a recording medium by use of an ink jet recording head, includes a platen for supporting a recording medium in a position facing the ink jet recording head, a plurality of carrier roller pairs for nipping and carrying the recording medium to the position of ink deposition by the ink jet recording head and extrusions extended in the carrying direction of the recording medium with respect to the platen and arranged in the direction intersecting the carrying direction of the recording medium to support the reverse side of recording medium. The carrier roller pairs are positioned on each of the extended lines of the extrusions on the upstream side relative to carrying direction of the recording medium. With the structure thus arranged, the floating of a recording medium from the platen can be suppressed so as to allow the gap to be formed narrower between the recording medium and recording head, hence making it possible to perform recording in higher quality.

19 Claims, 14 Drawing Sheets

INK JET RECORDING METHOD AND APPARATUS HAVING PLATEN WITH EXTRUSIONS POSITIONED IN ONE-TO-ONE CORRESPONDENCE WITH ROLLER NIPS

BACKGROUND OF THE INVENTION

1. Field of the Invention

The present invention relates to a recording apparatus that records images, such as characters, graphics, and patterns, by depositing ink to a recording medium by use of recording means.

2. Related Background Art

When recording is performed by the deposition of ink droplets to a recording medium, ink is absorbed into the recording medium, and the portion where ink is thus absorbed is subjected to swelling. Then, depending on the difference in the concentration of ink that adheres to the recording medium, a portion having a difference in stretching may occur. The largely stretched portion is caused to bend in the direction perpendicular to the recording surface of a recording medium of a sheet type. So-called cockling irregularities may take place. Here, the more time elapses, the more ink droplets are absorbed into the recording medium to bring about the swelling. Thus, the irregularities increase. When image data or the like is recorded, a technique is adopted to minimize the influence exerted by uneven pitches of feeding on the quality of recorded images by shortening the feeding pitches of the recording medium, while dividing the image data at random, so that the scanning frequency is increased for the carriage having recording means thereon for recording. When the feeding pitches are smaller as in this case, the recording time becomes longer to bring about a larger cockling. As a result, during the recording operation, the recording medium tends to bend in the direction toward recording means from the platen side where the recording medium is supported to face the recording means. In such condition, the sheet floating may take place with the result that the recording means is in contact with the recording medium to rub each other, and that the quality of recorded images is degraded eventually in some cases.

For the recording apparatus that adopts the ink jet recording method to record by discharging ink, the shorter the flying passage of ink, the higher becomes the accuracy of the landing positions of ink. For a recording apparatus of this kind, it is required to set the gap between the recording surface of a recording medium and the recording head (hereinafter referred to as a "head gap") as narrow as possible. On the other hand, if the head gap is made narrower, a rubbing of the kind as described above tends to occur more often.

Therefore, it is desirable to provide a method that can minimize the sheet floating that may be caused by cockling so that no rubbing occurs between recording means and a recording medium.

To prevent the sheet floating of a recording medium from the platen, a structure (a first conventional example) is disclosed in the specification of Japanese Patent Application Laid-Open No. 61-95966 in which a plurality of small holes are provided in the platen or suction force is allowed to act upon a recording medium through small holes by use of negative pressure generating means, thus the recording medium being held closely in contact with the platen.

Also, in the specification of Japanese Patent Application Laid-Open No. 4-69264, a mechanism (a second conventional example) that presses a recording medium by use of a paper pressure member arranged on the upstream side in the carrying direction of the recording medium is disclosed.

Further, in the specification of Japanese Patent Application Laid-Open No. 9-48161, an ink jet recording apparatus (a third conventional example) is disclosed in which a plurality of ribs, which are extended on a flat platen in the carrying direction of a recording medium, are arranged in the direction intersecting the carrying direction of the recording medium, and, on the upstream side of the ribs, a pressure plate is arranged extending in the direction intersecting the carrying direction of the recording medium in order to nip the recording medium together with each tip of the ribs. Also, for this ink jet recording apparatus, extrusions are arranged on the respective positions of the pressure plate corresponding to each of the gaps between ribs, thus exerting the force that presses the recording medium downward.

For the first conventional example described above, there is a need for the provision of negative pressure generating means, which inevitably makes the apparatus larger, and the costs of manufacture higher as well. There is also a problem that the noise level increases when the air is taken in and exhausted. Further, when recording is effected on a smaller recording medium, the suction efficiency is extremely lowered to the extent that the dependability becomes inferior if many of the fine holes arranged for the platen are located outside of the edges of the recording medium to be used. If the arrangement is such that all the fine holes are covered even by a smaller sized recording medium, it becomes impossible to exert the suction force over the entire surface of a larger recording medium. As a result, the dependability also becomes inferior. In order to solve such problems, it is necessary to provide means for closing the fine holes that may be located outside of the edges of a smaller sized recording medium. However, the structure becomes considerably complicated to make the costs of manufacture higher.

For the second conventional example, there is a possibility that a recording medium is not pressed sufficiently close to the platen if the recording area is wide. In other words, the recording medium is pressed by the paper pressure member to the platen on the upstream side, while being nipped by the sheet exhaust roller or the like on the downstream side. However, the recording medium is not pressed at all at the recording area or the like which exists between these sides. As a result, if the recording area is wide so that each line portion of the recording head is correspondingly wider, there is a fear that the recording medium is caused to float from the platen or that cockling takes place on the recording medium at the recording area with downward pressure being exerted only by the paper pressure member on the upstream side and by the exhaust rollers on the downstream side. Further, in order to suppress the paper sheet floating, if the nipping portion of the exhaust roller pair is positioned lower than the guiding surface of the platen, there is a problem encountered that the trailing end of the recording medium is allowed to float after the recording sheet is conveyed away from the paper pressure member.

For the third conventional example, the paper pressure plate is arranged without any exception on a position that is substantially in contact with the leading end of each of the ribs on the upstream side thereof. However, it is impossible to exert any force to press the recording medium to the platen side by the nipping portion of the recording medium by each of the leading ends of ribs and the paper pressure plate. Also, there is a problem that the ribs, which are set on the lower face of the paper pressure plate and arranged upstream in the gaps between adjacent platen ribs, cannot prevent the floating of a recording medium from the platen completely in a case where a comparatively robust recording medium, such as cardboard, is carried or recording is performed on a wide recording area, although there is an effect that the recording medium is pressed in the direction of the platen when the recording medium is placed in a position between ribs.

SUMMARY OF THE INVENTION

The present invention is designed with a view to solving the problems discussed above. It is an object of the invention to provide an ink jet recording apparatus capable of preventing a recording medium from floating toward recording means with a simple structure at lower costs.

Also, it is another object of the invention to provide an ink jet recording apparatus, which records with deposition of ink droplets to a recording medium by use of ink jet recording means, and comprises a platen for supporting a recording medium in a position facing the ink jet recording means; a plurality of carrier roller pairs for nipping and carrying the recording medium to the position of ink deposition on the recording medium by the ink jet recording means; and extrusions extended in the carrying direction of the recording medium with respect to the platen, at the same time, being arranged in a plurality in the direction intersecting the carrying direction of the recording medium to support the reverse side of recording medium. Here, the carrier roller pairs are positioned on each of the extended lines of the extrusions on the upstream side of the carrying direction of the recording medium.

It is still another object of the invention to provide an ink jet recording apparatus, which is provided with a carrier roller unit having a plurality of roller pairs arranged on the upstream side of the recording area, and a platen arranged on the downstream side of the carrier roller unit for supporting a recording medium in a position facing recording means, and comprises nipping portions of the carrier roller unit for nipping the recording medium by use of a plurality of the roller pairs thereof, and non-nipping portions; a plurality of ribs arranged for the platen, and positioned on extended lines of the nipping portions in the carrying direction of the recording medium, and extended in the carrying direction of the recording medium; and a standard position for carrying a recording medium capable of aligning one edge portion of the recording medium irrespective of the sizes of the recording medium. Here, one of the plurality of ribs is arranged in a position inside the other edge of the recording apparatus of regular size by 1 mm to 10 mm.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Hereinafter, with reference to the accompanying drawings, description will be made of the embodiments in accordance with the present invention.

First Embodiment

Figure 1:
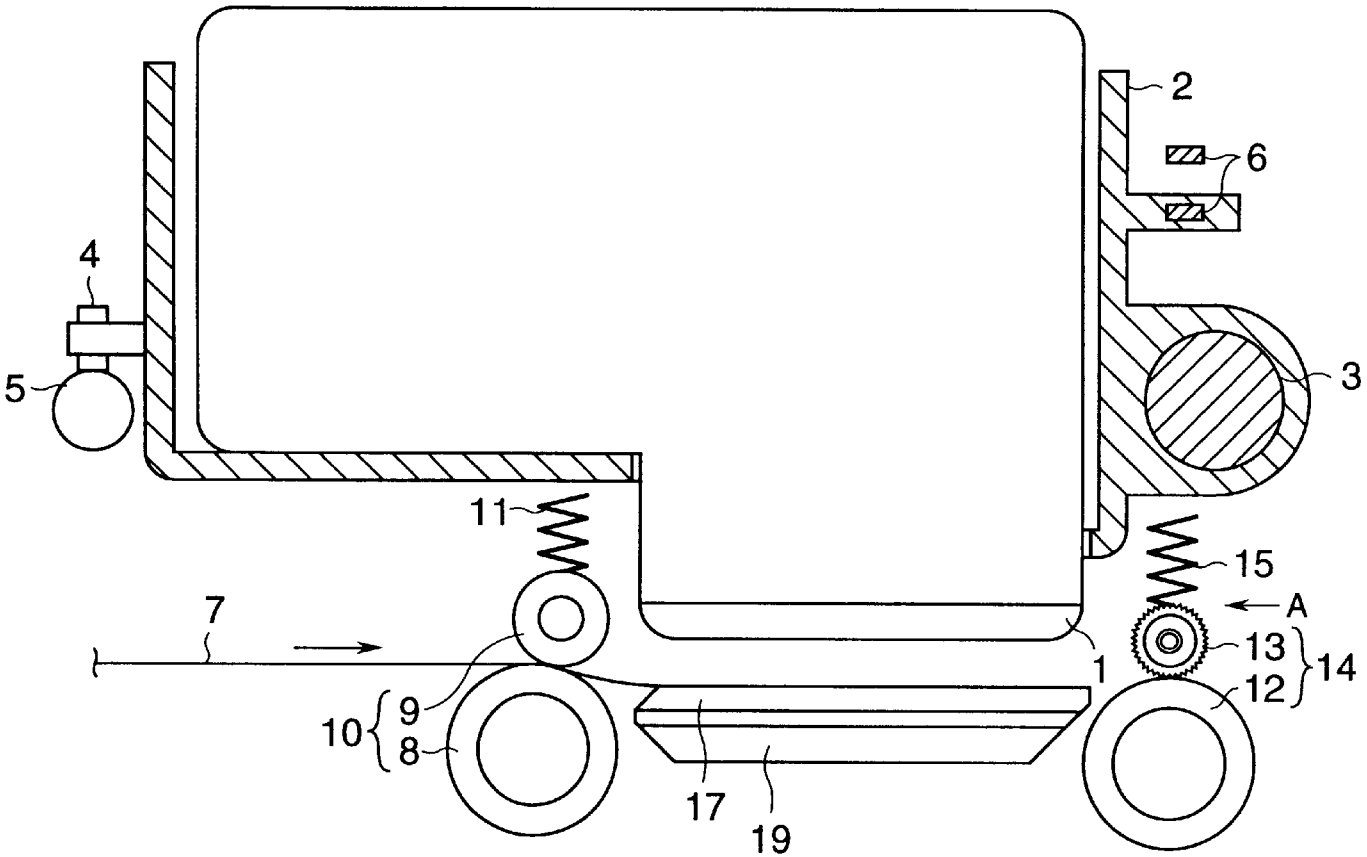
FIG. 1 is a cross-sectional view which shows the region of recording means of a recording apparatus in accordance with a first embodiment of the present invention.
Figure 2:
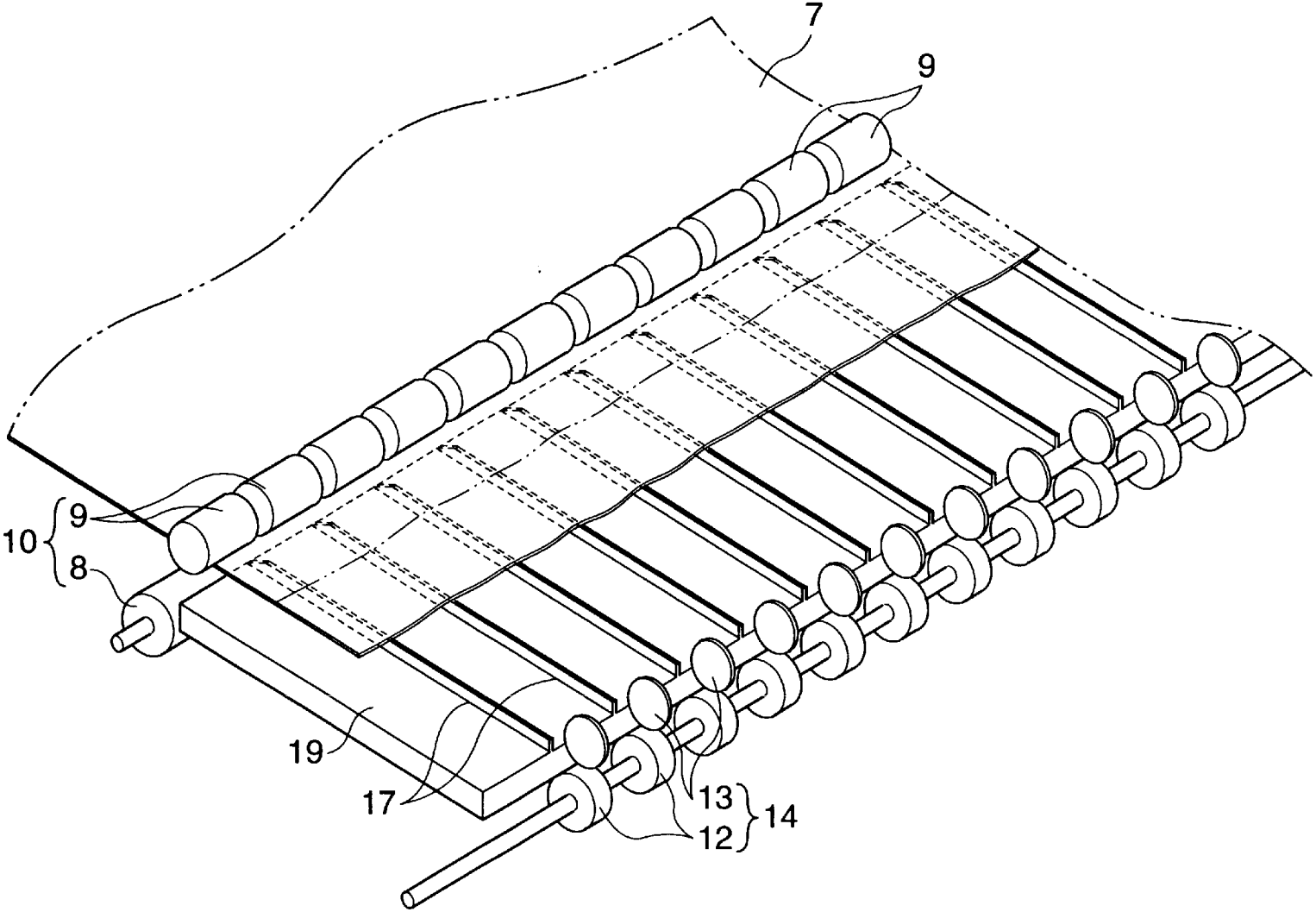
FIG. 2 is a perspective view which schematically shows the region of a recording area of the recording apparatus in accordance with the first embodiment of the present invention.

FIG. 1 is a cross-sectional view which shows the region of the recording means of a recording apparatus in accordance with a first embodiment of the present invention. FIG. 2 is a perspective view which schematically shows the region of the recording area thereof.

As shown in FIG. 1, the recording apparatus of the present embodiment is provided with a recording head 1 of an ink jet recording type that records images or the like with the deposition of ink droplets discharged to a recording medium.

First, description will be made of the scanning mechanism of the recording means. The recording head 1 is detachably mounted on a carriage 2. The carriage 2 is slidably supported on a guide rail 3, and a guide roller 4, which protrudes from the carriage 2, is rotatively supported on a supporting rail 5.

Then, being driven by a carriage motor (not shown) through a timing belt 6, the carriage 2 scans along the guide rail 3 and the supporting rail 5. In synchronism with the scanning of the carriage 2, ink droplets are discharged from the recording head 1 mounted on the carriage 2 to specific positions on a recording medium 7 for recording an image or the like thereon.

Now, the carrying mechanism for the recording medium 7 will be described. On the upstream side of the carrying path of the recording head 1, there is arranged a carrier roller unit 10 comprising upstream side carrier roller 8 which is driven by a motor (not shown) and driven rollers 9 which are pressed to the upstream side carrier roller 8 by means of a biasing spring 11 to rotate following the rotation thereof. The rotational center of each driven roller 9 is placed in a position slightly deviated to the downstream side in the carrying direction from the rotational center of the upstream side carrier roller 8. Therefore, the carrier roller unit 10 urges the recording medium 7 diagonally downward, while pressing it to platen 19. In other words, each driven roller 9 functions as a pressure roller that presses the recording medium 7 to the platen 19. For the present embodiment, if the structure is arranged so that each of the driven rollers 9 is individually biased by means of the biasing spring 11, it becomes possible to press the recording medium 7 appropriately in accordance with the amount of deformation of each portion thereof.

The platen 19 is arranged to face the recording head 1. Then, on the guiding surface for the recording medium 7, a plurality of extrusive ribs 17, each extruded in the carrying direction, are arranged in line in a direction intersecting the carrying direction. A plurality of the driven rollers 9 are arranged corresponding to these ribs 17, and the central position of each of the driven rollers 9, in the direction of the rotational axis, and the central position of a corresponding one of the ribs 17 are arranged to be on one and the same line in the carrying direction.

On the downstream side of the recording head 1 on the carrying path, there is arranged a sheet exhaust roller unit 14 which comprises downstream side carrier rollers 12 driven by a motor (not shown), and spurs 13, serving as the rotational devices used for sheet exhaust, which are biased by means of biasing spring 15 to rotate following the rotation of the downstream side rollers 12. Each of the spurs 13 has a small contact area with the recording medium 7 so that recorded images are not spoiled even when the spurs are in contact with the recording surface thereof after recording. Each of the sheet exhaust roller pairs of the sheet exhaust roller unit 14 is provided with a nipping portion to nip the recording medium 7, and a portion which is not in contact with the recording medium (non-nipping portion) alternately in the direction intersecting the carrying direction of the recording medium. Each of these portions is positioned to arrange each of the nipping portions and the vertices of a corresponding one of the ribs 17 to be on one and same straight line in the carrying direction. On the upstream side of the ribs 17 in the carrying direction, the nipping portions are positioned without any exception.

Now, description will be made of the recording operation of the recording apparatus.

By the sheet feeding mechanism, which is not shown, the recording medium 7 is carried to the nipping portion of the carrier roller unit 10. Then, by the rotation of the carrier roller unit 10, the recording medium is carried on the platen 19 to the recording position that faces the recording head 1. The recording head 1 is guided to the recording position by the scanning of the carriage 2 where the recording operation is carried out for the deposition of ink onto the recording medium 7. During the recording operation, the carrier roller unit 10 carries the recording sheet 7 at specific pitches. Then, when the recording medium 7 reaches the sheet exhaust roller pairs 14 by means of sheet feeding, the sheet is carried by the cooperation of the sheet exhaust roller unit 14 and the carrier roller unit 10. After the trailing end of the recording medium 7 leaves the carrier roller unit 10, the sheet is carried only by the sheet exhaust roller unit 14. When the recording operation is completed, the sheet exhaust roller unit 14 ejects the recording medium 7 onto a sheet exhaust tray, which is not shown.

Figure 3:
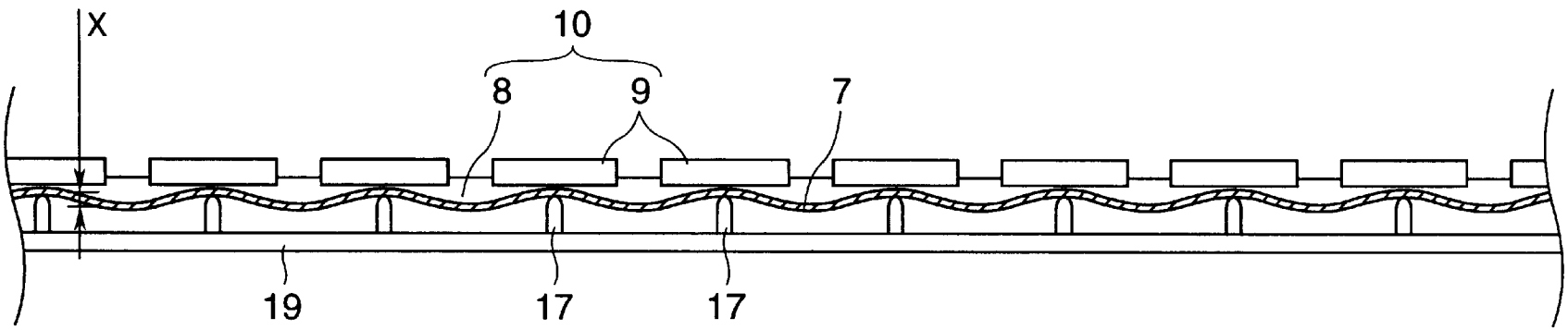
FIG. 3 is a view which schematically shows the state of a recording medium before a recording operation, observed in the direction indicated by an arrow A in FIG. 1.
Figure 4:
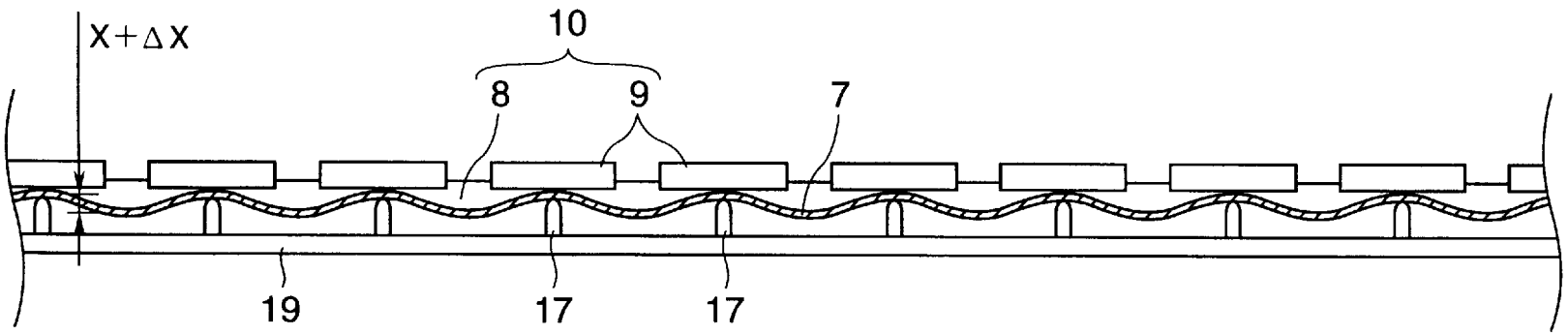
FIG. 4 is a view which schematically shows the state of a recording medium after the recording operation, observed in the direction indicated by arrow A in FIG. 1.

Now, in conjunction with FIG. 3 and FIG. 4, description will be made of the behavior of the recording medium 7 before and after the recording operation on the assumption that an ordinary paper sheet is used, which is a thinner recording medium subject to the occurrence of cockling in particular. FIG. 3 and FIG. 4 are views observed in the direction indicated by an arrow A in FIG. 1. FIG. 3 shows the state of the ordinary paper sheet before recording. FIG. 4 shows the state where cockling occurs on the ordinary paper sheet after recording.

The recording medium 7 is carried, while being pressed by the driven rollers 9 from diagonally above, to the platen 19. In other words, since each rotational center of the driven rollers 9 is placed in the position deviated to the downstream side of each rotational center of the upstream side carrier rollers 8, the pressure exerted by the driven rollers 9 is not absorbed only by the upstream side carrier rollers 8. Thus, the pressure also acts in the direction in which the recording medium 7 is pressed to the platen 19. In this manner, the recording medium 7 abuts against the platen 19 diagonally and is caused to bend between the contact surfaces of the carrier roller unit 10 and the platen 19. As a result, the biasing force is exerted to press the recording medium 7 to the platen 19. This biasing force is obtainable most effectively by arranging the center of each rib 17 and that of the driven rollers 9 on one and same straight line in the carrying direction of the recording medium 7. However, the substantially equal biasing force may be obtainable at least by arranging one of the driven rollers 9 in the area of each rib 17 upstream relative to the carrying direction of the recording medium 7 without exception. The recording medium 7 thus pressed to the platen 19 abuts against the ribs 17 to be bent and recessed between ribs 17. Then, as shown in FIG. 3, the recording medium is deformed to present moderate corrugation with the surfaces in contact with ribs 17 as the vertices thereof.

Now, when the recording ink, whose main solvent is water, adheres to the recording medium 7 by use of the recording head 1, the recording medium 7 swells by the absorption of water to bring about the occurrence of cockling. Here, on the contacted surface between the recording medium 7 and each of the ribs 17, sheet floating does not easily take place due to the pressure exerted thereon. On the other hand, at each portion where the recording medium 7 is not in contact with the platen 19, that is, each portion between the ribs 17, the deformation (cockling) occurs on the platen side, which is the deforming direction of the recording medium 7 before recording. In other words, the waving amount X of the recording medium 7 before recording changes into the waving amount $X+\Delta X$ after recording. In this way, it is possible to absorb the swelling deformation of the recording medium 7 almost completely by the concave bending thereof between ribs 17. Also, due to the presence of ribs 17, the recording medium 7 tends to create the wavy deformation in the direction perpendicular to the carrying direction thereof, but the deformation is not easily caused in the carrying direction. Hence, in accordance with the present embodiment, the deformation caused by the swelling of the recording medium 7 is absorbed by the increased amount of the wavy deformation directed toward the platen 19 side. As a result, it becomes possible to suppress the sheet floating toward the recording head 1 side. With the suppression of the sheet floating, the contact between the recording medium 7 and the recording head 1 is controlled so as to suppress the occurrence of unfavorable influence to the recorded images.

In this respect, each of the sheet exhaust roller pairs 14 is structured to nip only the vertices of the wavy deformation of the recording medium 7, that is, to nip only the portions positioned at the vertices of the ribs 17. As a result, there is no possibility that the deformation of the recording medium 7 is corrected, and that the effect produced by the wavy deformation of the recording medium 7 described above is not spoiled. Also, after the recording medium 7 leaves the carrier roller unit 10, the sheet floating can be suppressed due to the fact that the recording medium 7 is no longer pressed by the sheet exhaust roller unit 14 to the platen 17.

In accordance with the present embodiment, it becomes possible to narrow the gap between the recording head 1 and the platen 19 (head gap), because the sheet floating can be suppressed. Particularly when the recording head 1 of ink jet recording type is used, the distance of the flight of discharged ink is made smaller by narrowing the head gap, hence providing a high quality recording apparatus which presents highly precise positions of ink deposition.

Second Embodiment

Figure 5:
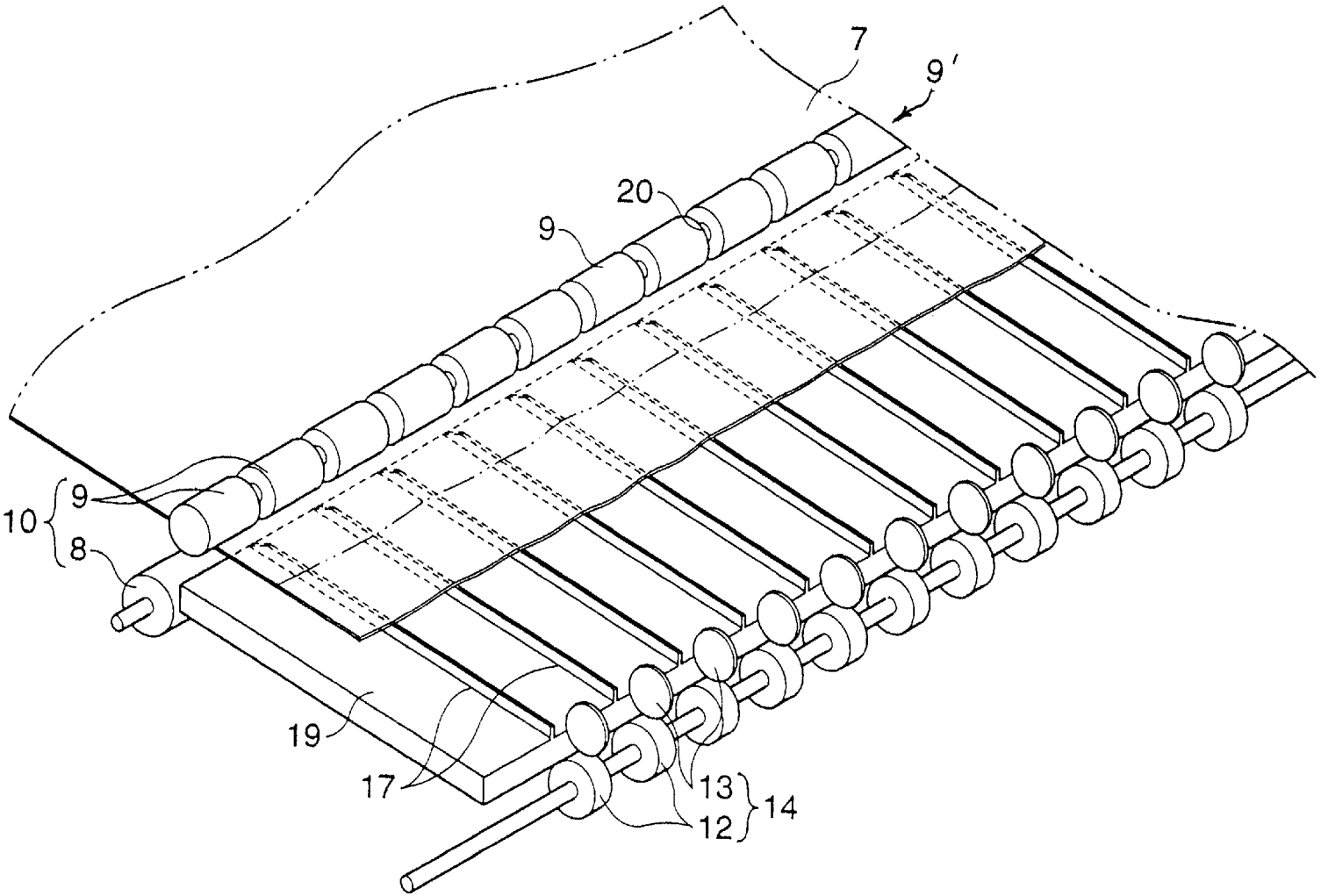
FIG. 5 is a perspective view which shows schematically the region of a recording area of a recording apparatus in accordance with a second embodiment of the present invention.

In conjunction with FIG. 5, description will be made of a recording apparatus in accordance with a second embodiment of the present invention. In FIG. 5, the same reference characters are applied to the same parts as those in the first embodiment, and the description thereof will be omitted.

In FIG. 5, each of the carrier roller pairs of the carrier roller unit 10 is formed by the upstream side carrier rollers 8, and the driven roller unit 9' which is provided with a plurality of irregular shapes in the axial direction. Then, the arrangement is made so as to position the ribs 17 and the substantially central location of extruded portions of the driven roller unit 9' in the axial direction to be on the same straight lines in the carrying direction. Then, particularly, on each extended line of ribs 17 upstream in the carrying direction, the nipping portion, which formed by each driven roller 9 and carrier roller 8, is positioned without exception.

Here, by use of the driven roller unit 9' having a plurality of the driven rollers 9 as in the first embodiment, which are connected by the shaft 20, it becomes possible to reduce the number of parts, such as the roller supporting mechanism and the biasing spring, and form a simpler structure to reduce the costs of manufacture accordingly. For the present embodiment, three driven rollers 9 are connected by the shaft 20 to form the driven roller unit 9'.

As described above, in accordance with the first and second embodiments, a recording medium is corrugated during the recording operation, and pressed to the platen, so as to absorb, with the increased amount of such corrugation, the cockling that may be created by the swelling of the recording medium by the absorption of ink, hence suppressing the sheet floating. Further, since the recording medium which is deformed to present corrugation is not easily deformed in the carrying direction thereof, the trailing end of the recording medium does not float easily even if the recording medium is pressed to the platen by the sheet exhaust roller pairs. With the suppression of the sheet floating, it is possible to narrow the gap between the recording surface of the recording medium and recording means to implement recording in higher quality.

Also, it becomes possible to suppress the sheet floating without increasing the number of parts, which produces favorable effect in terms of manufacturing costs.

Third Embodiment

Figure 6:
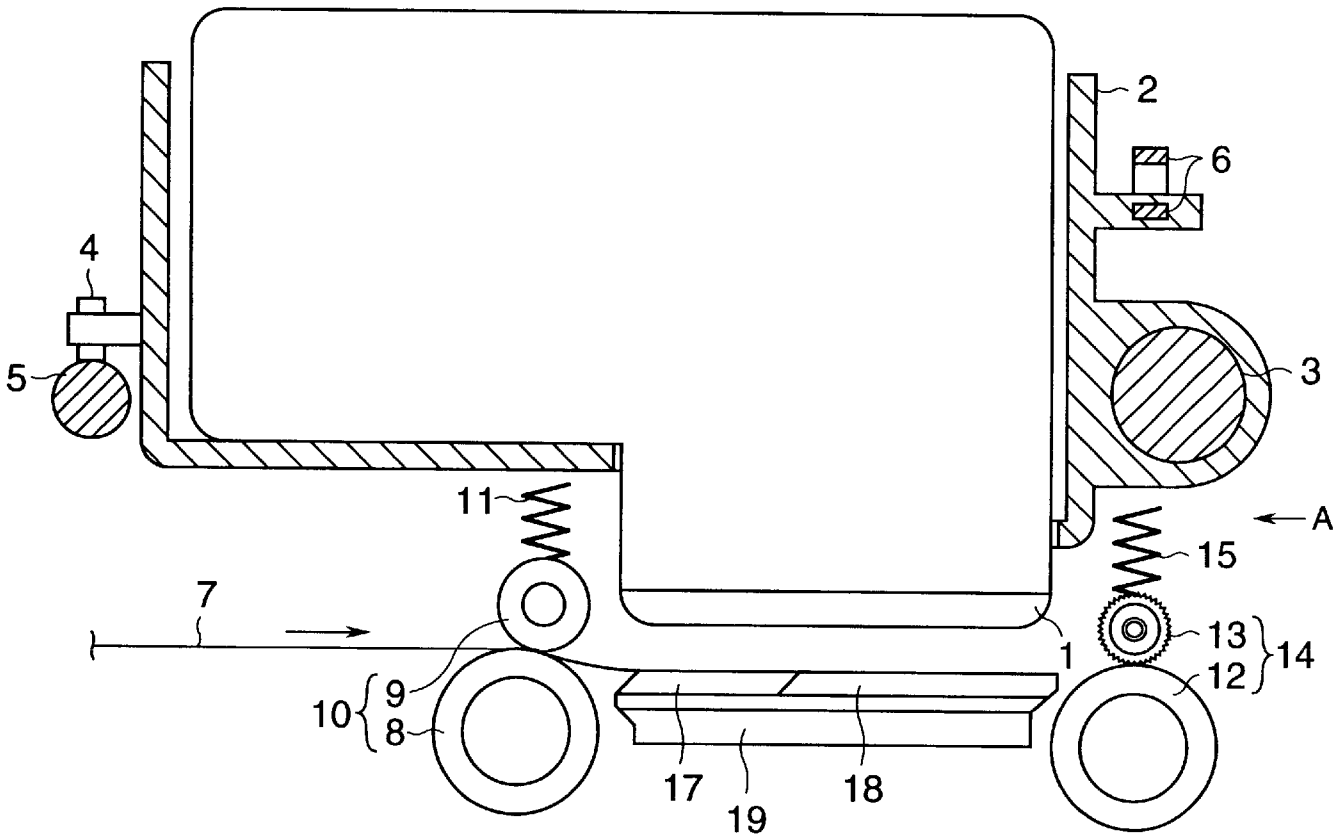
FIG. 6 is a cross-sectional view which shows schematically the region of recording means of a recording apparatus in accordance with a third embodiment of the present invention.
Figure 7:
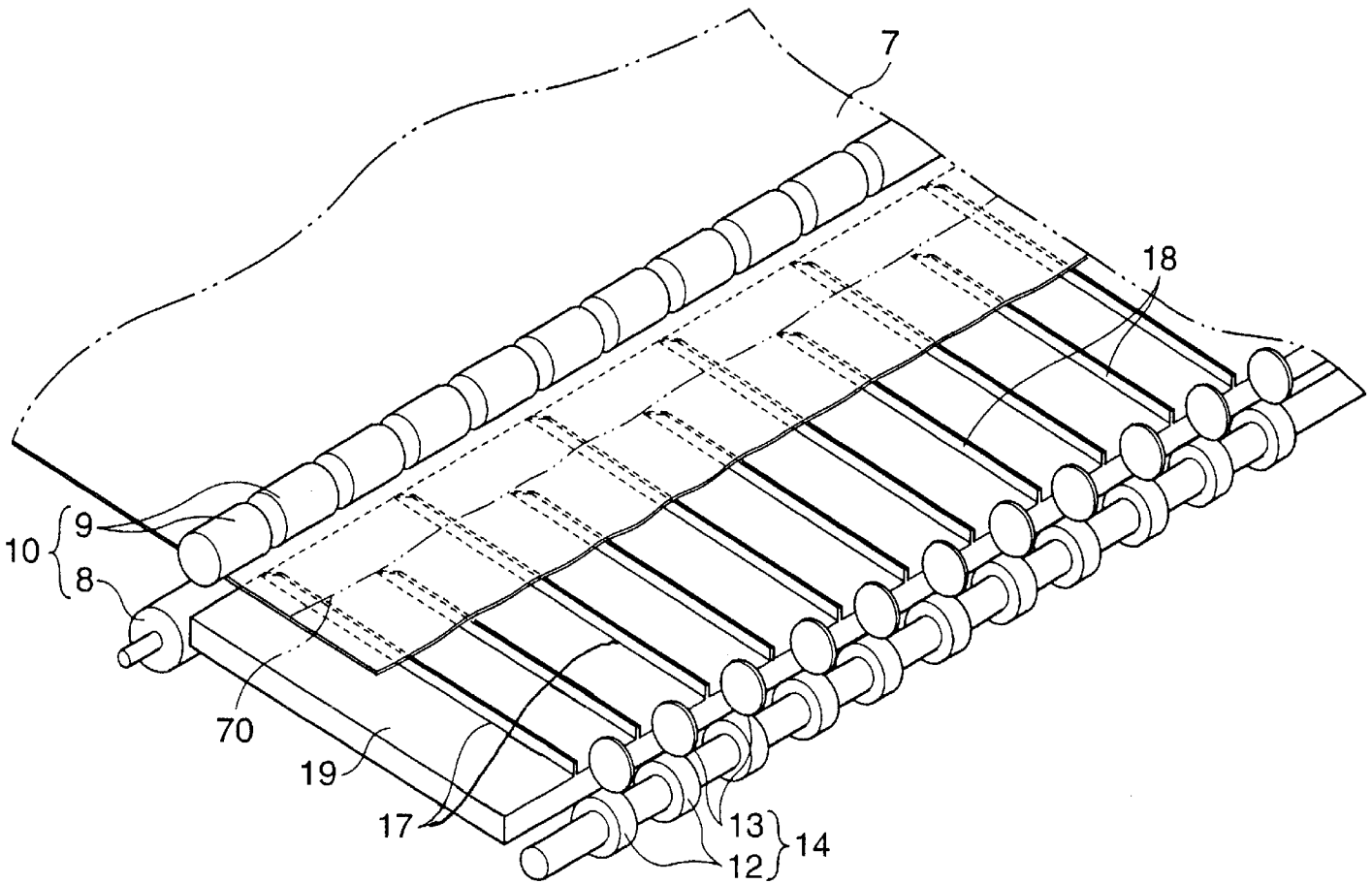
FIG. 7 is a perspective view which shows schematically the region of a recording area of the recording apparatus in accordance with the third embodiment of the present invention.

Now, description will be made of a recording apparatus in accordance with a third embodiment of the present invention. Here, FIG. 6 is a cross-sectional view which shows the region of the recording means thereof. FIG. 7 is a perspective view which schematically shows the recording area.

A difference between the first and second embodiments, which have been described above, and the third to fifth embodiments, which will be described hereinafter, is the provision of ribs 18 in addition to the ribs 17. In the following description, therefore, the same reference characters are applied to those structures which are shared by the first and second embodiments.

At first, the structure around the recording area will be described. As shown in FIG. 6 and FIG. 7, the platen 19 is arranged in the position facing the recording head 1 to guide and support a recording medium 7. For the platen 19, a plurality of ribs 17 and 18 are arranged as extrusions extended in the carrying direction of the recording medium 7, and are formed respectively on extended lines on the downstream side of a plurality of nipping portions of the carrier roller unit 10. The ribs 17 and the ribs 18 are different in the lengths thereof. The shorter ribs 18 originate from points set more on the downstream side in the carrying direction as compared with the longer ribs 17.

On the downstream side of the recording area of the recording head 1, the sheet exhaust roller unit 14, formed by sheet exhaust rollers 12 and spurs 13 which are pressed by biasing springs 15 to the sheet exhaust rollers 12 to rotate following the rotation thereof, is arranged to exhaust the recording medium 7 to a sheet exhaust tray (not shown) after the passage of the recording area. With a small contact area with the recording medium 7, the spur 13 is formed not to disturb the recorded images on the recording medium when it is in contact with the recording surface thereof after recording. The nipping portions of the sheet exhaust roller unit 14 are arranged downstream of the extended lines of the ribs 17 and 18, and the carrier roller unit 10. Particularly, on the extended lines upstream in the carrying direction of the ribs 17 and 18, the nipping portions of the carrier roller unit 10 are arranged without exception.

Now, description will be made of the recording operation of the recording apparatus. By the sheet feeding mechanism, which is not shown, a recording medium 7 is carried to the nipping portion between the carrier roller 8 and each driven roller 9 of the carrier roller unit 10. Then, after inclination and other characteristics are corrected, the recording medium 7 is carried by the rotation of the carrier roller 8 and the driven rollers 9 of the carrier roller unit 10 to the recording area of the recording head 1.

In the recording area, the transfer of the recording medium 7 is suspended. During this period, the carriage 2 scans along the guide rail 3 and the supporting rail 5. Then, in synchronism with the scanning of the carriage 2, one-line portion recording is performed by discharging ink droplets from the recording head 1 mounted on the carriage 2 to specific positions on the recording medium. When the scanning and recording are completed for the one-line portion, the recording medium 7 is carried by one-line portion by use of the carrier roller unit 10. Then, the transfer of the recording medium 7 is suspended again, and another one-line portion scanning of the carriage 2 and recording by the recording 1 are performed. In this manner, the recording medium 7 is carried and recording by the recording head 1 are conducted alternately to record on the entire recording surface of the recording medium 7.

In this respect, when the leading end of the recording medium 7 reaches each nipping portion between the sheet exhaust rollers 12 and spurs 13 of the sheet exhaust roller unit 14, the recording medium 7 is carried by the rotation of each sheet exhaust roller 12 and spur 13 of the sheet exhaust roller unit 14 in addition to the rotation of the carrier roller 8 and driven rollers 9 of the carrier roller unit 10. Further, when the trailing end of the recording medium 7 leaves the carrier roller 8 and driven rollers 9 of the carrier roller unit 10, the recording medium 7 is carried only by the rotation of each sheet exhaust roller 12 and spur 13 of the sheet exhaust roller unit 14.

With the completion of recording on the entire recording surface of the recording medium 7 as described above, the recording medium 7 is exhausted after recording by the sheet exhaust roller unit 14 to the sheet exhaust tray, which is not shown.

Now, with reference to FIG. 7 to FIG. 10, description will be made of the behavior of the recording medium 7 before and after the recording operation on the assumption that an ordinary paper sheet is used, which is a thinner recording medium subject to the occurrence of cockling in particular.

Figure 8:
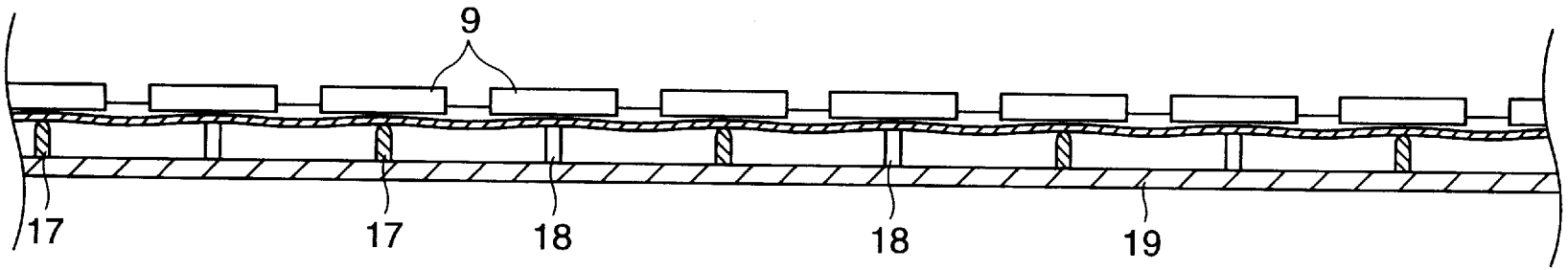
FIG. 8 is a view which shows schematically the state where a recording medium is in contact only with longer ribs, observed in the direction indicated by arrow A in FIG. 6.

As shown in FIG. 7 and FIG. 8, since the rotational center of each driven roller 9 is deviated from the rotational center of the carrier roller 8 to the downstream side in the carrying direction, the ordinary paper sheet (recording medium) 7 is carried, while being pressed by the driven rollers 9 to the platen 19. In other words, since each rotational center of the driven rollers 9 is deviated, the pressure exerted by the driven rollers 9 is not only absorbed by each carrier roller 8, but also, it acts in the direction toward the platen 19. In this manner, the recording medium 7 is carried, while being pressed downward diagonally. Here, as shown in FIG. 8, the ordinary paper sheet 7 is placed along the ribs 17, and at the same time, it forms the recessed form by the biasing force exerted between the ribs 17, hence providing the moderately corrugated shape as indicated by two-dot chain line at 70 in FIG. 7.

Figure 9:
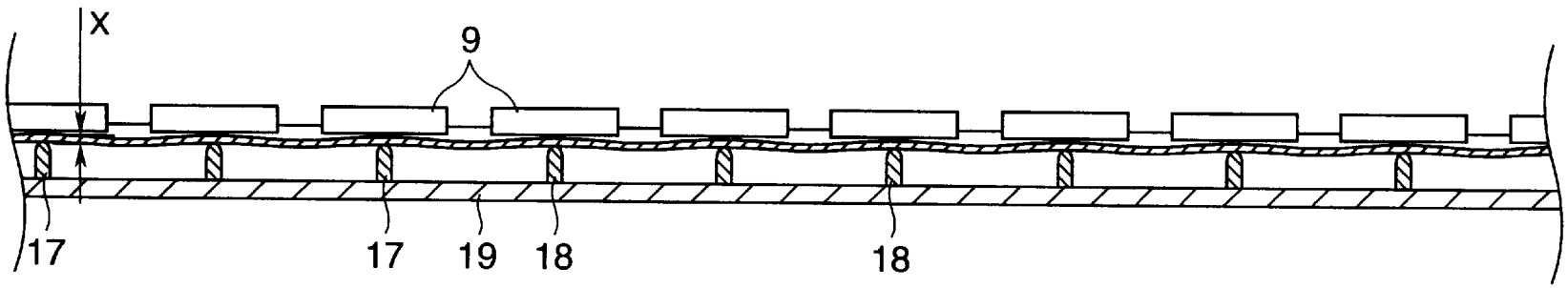
FIG. 9 is a view which shows schematically the state where a recording medium is in contact only with shorter ribs, observed in the direction indicated by arrow A in FIG. 6.

When the ordinary paper sheet is further carried, each portion which is corrugated between ribs 17 (the leading end of the ordinary paper sheet 7) abuts against each of the ribs 18 to be pushed upward. Then, as shown in FIG. 9, the corrugated shape is formed with the ribs 17 and 18 as the vertices thereof. In accordance with the present embodiment, each originating point of the ribs 18 is positioned more downstream than each originating point of the ribs 17 in the carrying direction. Therefore, the pressure which is exerted by the carrier roller unit 10 to press the ordinary paper sheet (recording medium) 7 in the direction toward the platen 19 can be maintained longer toward the downstream side (the amount of corrugation at this time is indicated by X in FIG. 9).

Figure 10:
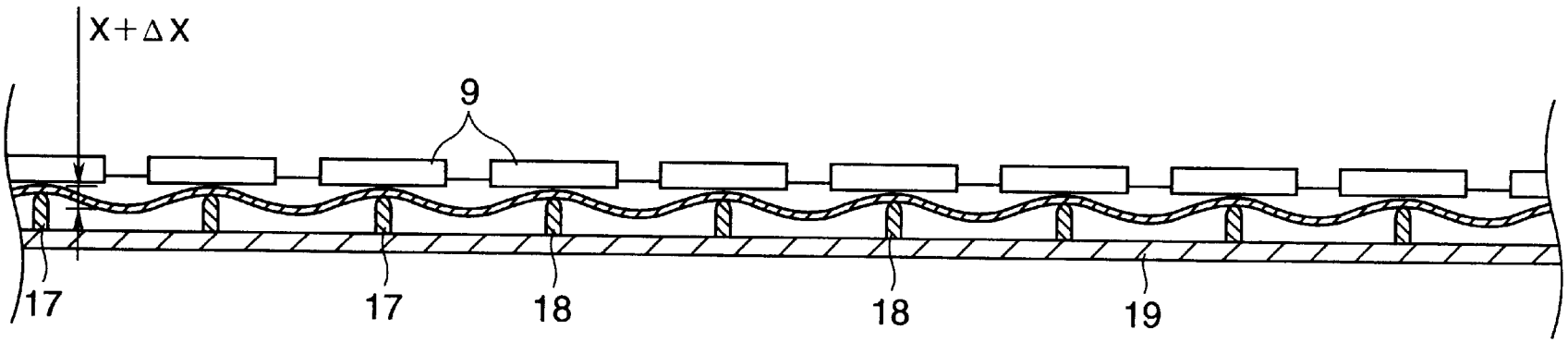
FIG. 10 is a view which shows schematically the state where cockling occurs in a recording medium after recording, observed in the direction indicated by arrow A in FIG. 6.

Then, when the recording ink, whose main solvent is water, adheres to the ordinary paper sheet 7 by use of the recording head 1, the ordinary paper sheet 7 swells by the absorption of water to bring about the occurrence of cockling as shown in FIG. 10. In accordance with the present embodiment, since the ribs 17 and 18 are arranged on the extended lines on the downstream side of the driven rollers 9, the portions nipped by the carrier roller unit 10 are securely pressed to the ribs 17 and 18. As a result, even if a greater deformation is made by swelling, most of such deformation is absorbed by the increased amount of bending to the platen side between ribs 17 and 18. In other words, the ordinary paper sheet 7 is recessed in the form of corrugation in advance between the ribs 17 and 18 on the platen 19, and the pressure, which is exerted by the carrier roller unit 10 to press the ordinary paper sheet 7 to the ribs 17 and 18, is maintained after the occurrence of swelling. As a result, the cockling takes place downward as shown in FIG. 10 to enable the recording sheet 7 to form between the ribs 17 and 18, with the recessed portion of the corrugated amount indicated by $(X+\Delta X)$ in FIG. 10, respectively, hence making it possible to prevent the recording sheet from floating to the recording head 1 side.

Then, the ordinary paper sheet 7 having the cockling, which has taken place in the recording area, is carried to the sheet exhaust tray, which is not shown, by use of the sheet exhaust roller unit 14. However, since the sheet exhaust roller unit 14 is arranged substantially on the one and same straight lines in the carrying direction along the ribs 17 and 18, there is no possibility that the moderate corrugation formed for the sheet in the recording area and the irregularities provided therefor by cockling are allowed to change.

Figure 11:
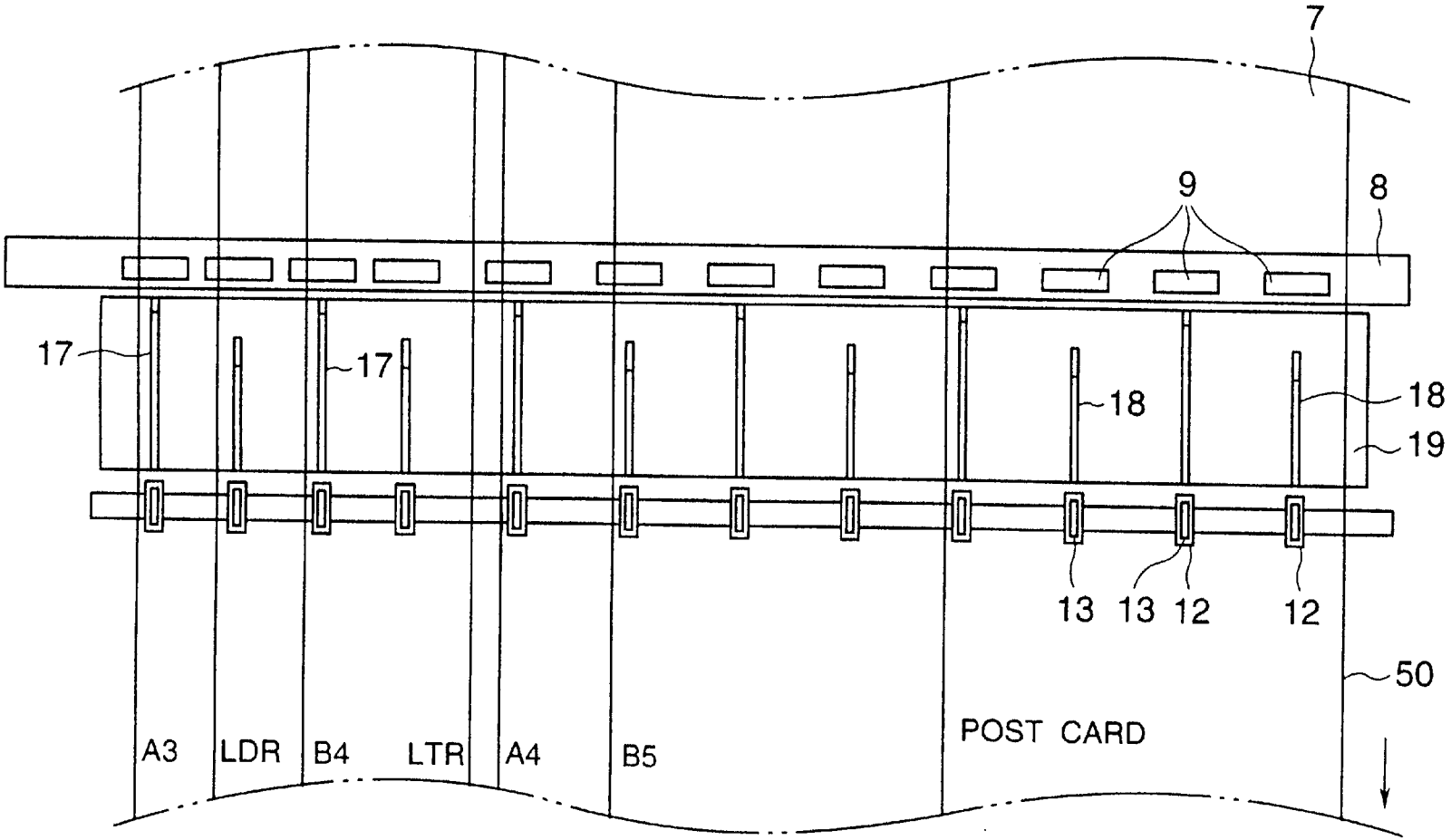
FIG. 11 is a plan view which shows the region of a recording area in accordance with the third embodiment of the present invention.

For a recording apparatus, the size of the recording medium (recording sheet) to be used is usually predetermined to a certain extent. For example, it is assumed that the general printer or the like uses either one of recording media, such as postcard, B5, A4, LTR (letter size), B4, LDR (leisure size), and A3. Here, therefore, in accordance with the present embodiment, the ribs 17 and 18 are positioned to be placed inside 1 mm to 10 mm of the side end portions of a recording medium depending on each size of the recording medium to be used. More specifically, as shown in FIG. 11, the standard position 50 is defined for carrying each medium. One edge portion of a recording medium 7 is aligned with this standard portion 50 for carrying the medium. The ribs 17 and 18 are arranged inside approximately 1 mm to 10 mm of the predetermined position of the other edge portion of the recording medium 7 of each size. For the portions other than those predetermined ones, a plurality of ribs 17 or 18 are arranged so that these ribs are set regularly to a certain extent. Here, as described earlier, the carrier roller unit 10 and the sheet exhaust roller unit 14 are arranged substantially on the extended lines of all the ribs 17 or ribs 18 in the carrying direction.

With the structure thus arranged, a recording medium 7 is carried with the side ends thereof placed along the ribs 17 or ribs 18, and further, carried while being nipped by the sheet exhaust roller unit 14 on the downstream side. As a result, it becomes possible to prevent the recording sheet 7 from floating to the recording head 1 side more reliably on the side end portions thereof.

Fourth Embodiment

Figure 12:
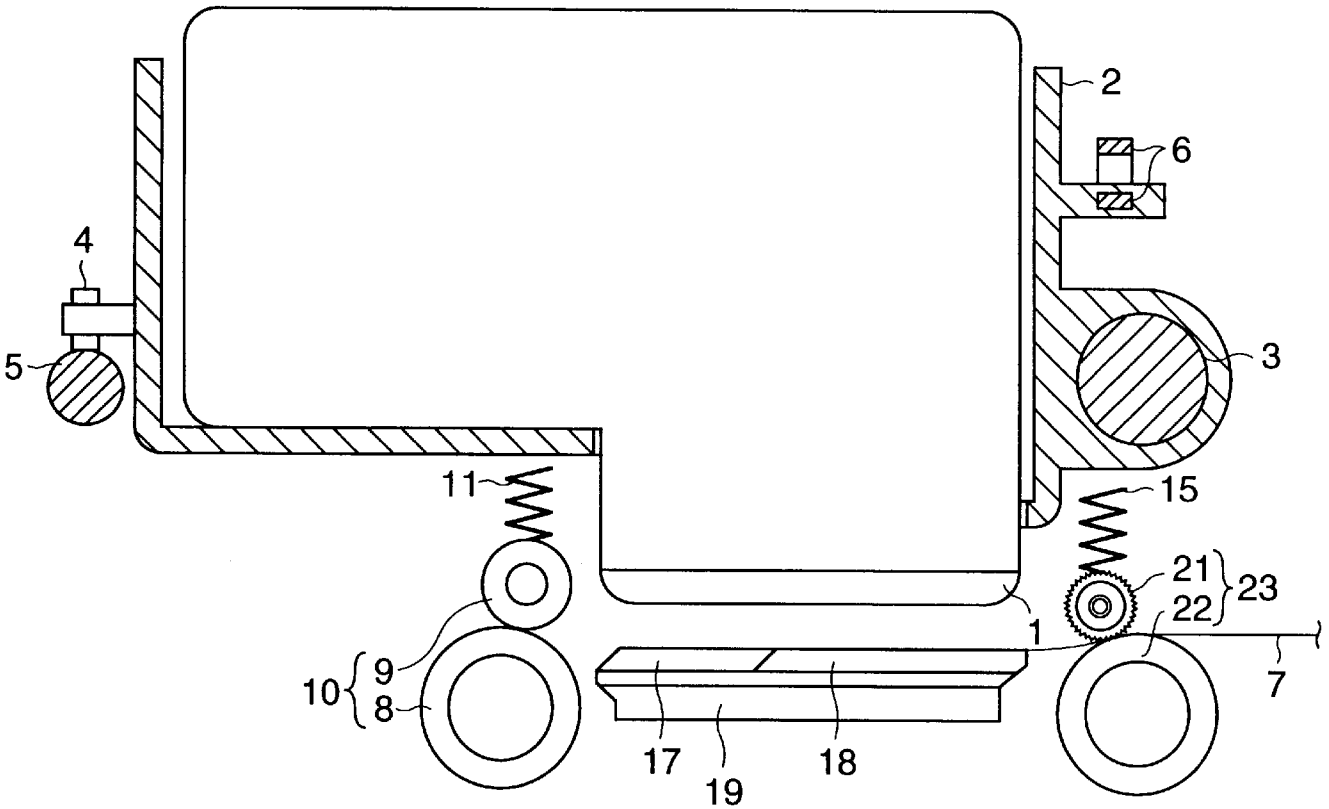
FIG. 12 is a cross-sectional view which shows the region of recording means in accordance with a fourth embodiment of the present invention.

Now, in conjunction with FIG. 12, description will be made of a fourth embodiment in accordance with the present invention. FIG. 12 is a cross-sectional view which shows the region of the recording means of a recording apparatus. The same reference characters are applied to the structures which are the same as those appearing in the third embodiment and the description thereof will be omitted.

As shown in FIG. 6, in the third embodiment each rotational center of the sheet exhaust rollers 12 and that of the spurs 13 are overlapped with each other. In accordance with the fourth embodiment, however, each spur 21 of the sheet exhaust roller pair is arranged to be in the position where the rotational center thereof is deviated more upstream of each rotational center of the sheet exhaust rollers 22 in the carrying direction. As a result, even after the trailing end of the recording medium 7 has passed the carrier roller unit 10, the recording medium is pressed by the spurs 21 toward the ribs 17 and 18 to prevent it from floating to the recording head 1 side.

Fifth Embodiment

Figure 13:
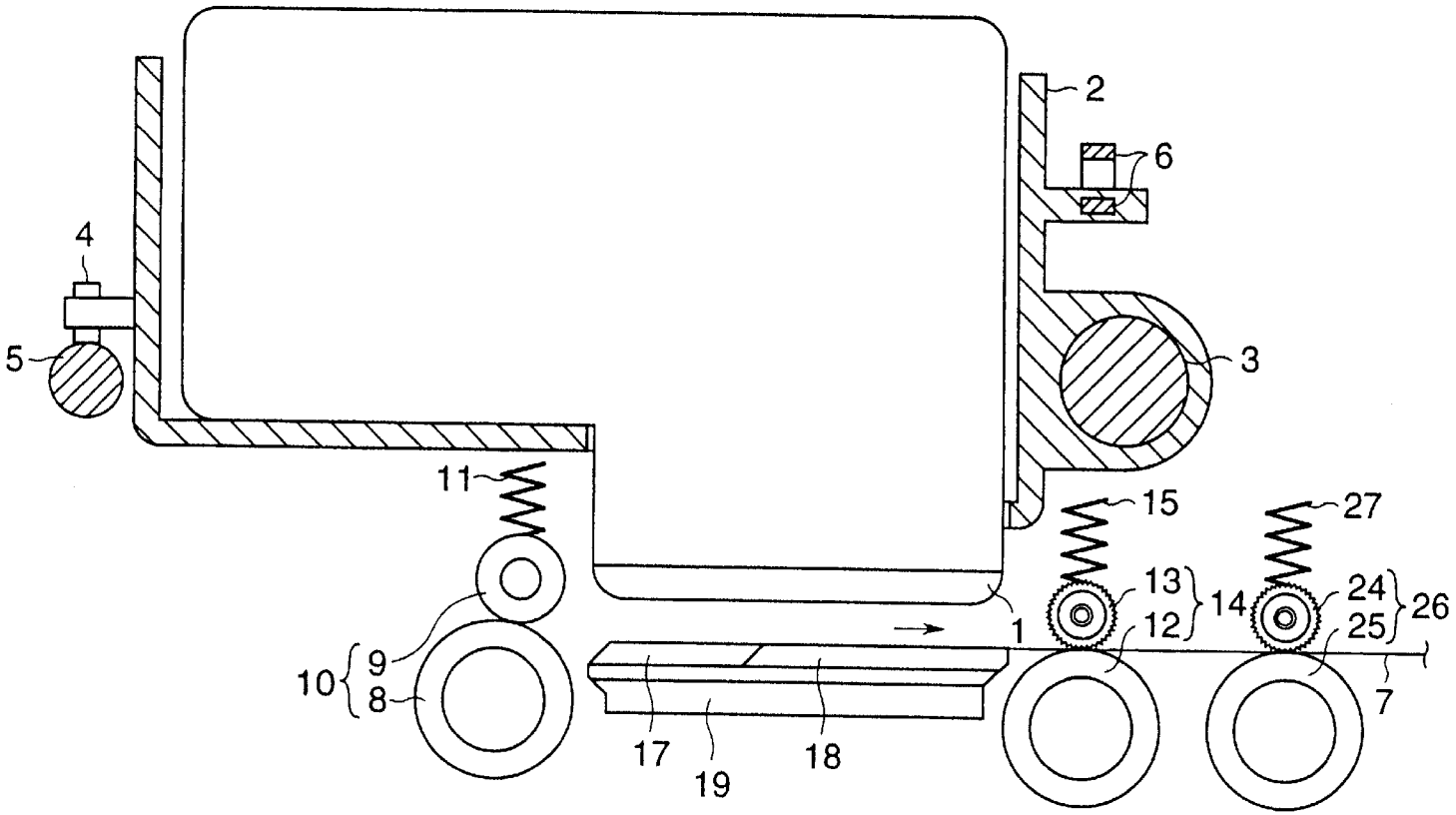
FIG. 13 is a cross-sectional view which shows the region of recording means in accordance with a fifth embodiment of the present invention.
Figure 14:
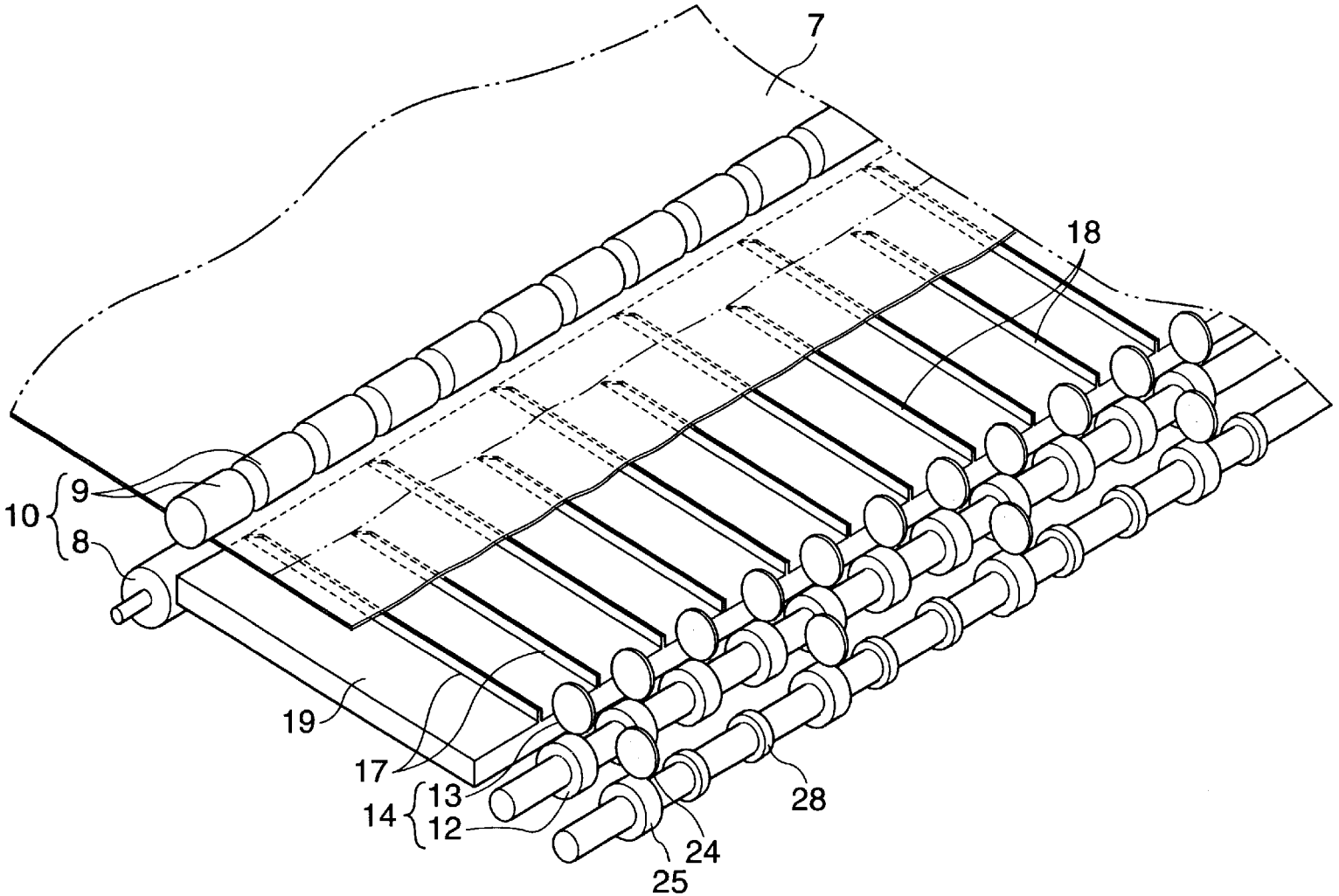
FIG. 14 is a perspective view which shows schematically the region of a recording area in accordance with the fifth embodiment of the present invention.

Now, in conjunction with FIG. 13 and FIG. 14, description will be made of a fifth embodiment in accordance with the present invention. FIG. 13 is a cross-sectional view which shows the region of the recording means of a recording apparatus. FIG. 14 is a schematic perspective view of a recording area thereof. Here, the same reference characters are applied to the structures which are the same as those appearing in the third embodiment. Therefore, the description thereof will be omitted.

As shown in FIG. 13, two sheet exhaust roller units 14 and 26 are provided for the present embodiment. In other words, as in the third embodiment, the present embodiment includes the sheet exhaust roller unit 14, which is formed by the sheet exhaust rollers 12 and the spurs 13 which are pressed to the sheet exhaust rollers 12 by use of the biasing spring 15 to rotate following the rotation thereof. Then, there is arranged for the present embodiment, the second row sheet exhaust roller unit 26, which is formed by the second row sheet exhaust rollers 25 and the second row spurs 24 pressed to the second row sheet exhaust rollers 25 by use of the biasing spring 27.

The second row spurs 24 and second row sheet exhaust rollers 25 of the second row sheet exhaust roller unit 26 are the same as those of the sheet exhaust roller unit 14, and are arranged on one and the same straight lines of the ribs 17 and 18 in the carrying direction of the recording medium 7. As a result, there is no possibility that the moderate corrugation formed in the recording area and the irregularities produced by cockling are allowed to change. Further, since the sheet exhaust roller units are arranged in two rows, it becomes possible to minimize the motion of the trailing end (the portion still residing in the recording area) of the recording medium 7 to float from the platen side to the recording head side by reaction even when the leading end of the recording media 7, which is exhausted (that is, the portion that has already left each nipping position of the sheet exhaust roller unit), is in a state where the leading portion thereof hangs downward by its own weight, that is, it is in the so-called bowing condition. In this manner, it is possible to prevent the recording medium 7 from floating to the recording head 1 side.

Also, as shown in FIG. 14, it may be possible to make the number of rollers and nipping portions less for the second row sheet exhaust roller unit 26 than those of the first row sheet exhaust roller unit 14. In this case, it may be possible to arrange, between each of the nipping portions of the adjacent rollers, rings 28 each having a smaller diameter than that of the second row sheet exhaust rollers 25. With the provision of such rings 28, it becomes possible to maintain securely the positions of the vertices of extrusions formed by corrugation or cockling of the recording medium 7 in the second row sheet exhaust roller unit 26. In this respect, as in the fourth embodiment, it may be possible to arrange the spurs to be in the positions where each rotational center of the spurs is deviated from each rotational center of the carrier rollers more upstream in the carrying direction. In this case, the recording medium 7 is pressed to the ribs 17 and 18, hence preventing it from floating to the recording head 1 side more reliably.

In accordance with the third to fifth embodiments, it is possible to suppress the floating of a recording medium, because ribs are arranged for the platen by use of the carrier roller unit on the extended lines of the nipping portions as described above.

Further, the two kinds of ribs having different lengths are provided, and the originating points thereof are changed alternately and arranged on the upstream side of the respective carrying directions. In this manner, the pressure is increased to press a recording medium on the ribs whose originating points are on the downstream side to make the preventive effect against the sheet floating more reliable. Then, with the pressure thus exerted, the recording medium is corrugated in advance, such as having extrusions on the portions where the recording medium is in contact with ribs, and,recesses on the portions where it is placed between ribs. As a result, the cockling that may occur on the recording medium is absorbed by the increased amount of deformation of the recessed portions, hence making it rare for cockling to cause the recording sheet to float.

Also, by arranging the driven rollers of the carrier roller unit to be deviated from each rotational center of the carrier rollers, respectively, it becomes possible to maintain the pressure toward the platen even when the recording medium leaves the carrier roller unit.

The structure is arranged so that with the establishment of the standard position for carrying a medium to align one edge portion of a recording medium to be used for a recording apparatus, the ribs are provided inside the other edge portion thereof by 1 mm to 10 mm, hence suppressing the edge portions from floating. Further, by positioning the nipping portions of the downstream side sheet exhaust roller unit on the extended lines of ribs, the floating suppression becomes more reliable.

Then, with the nipping portions of the sheet exhaust roller unit set on the same straight lines of ribs in the carrying direction of a recording medium, respectively, it becomes possible to carry the recording medium in the recording area without changing the corrugated condition or the irregularities formed by cockling.

Also, with the spurs of the sheet exhaust roller unit being arranged to be deviated from each rotational center of the sheet exhaust rollers, it becomes possible to obtain the pressure that may press a recording medium to the platen even after it leaves the carrier roller unit.

Further, with the sheet exhaust roller unit being arranged in two rows, it becomes possible to suppress the motion of the trailing end of a recording medium to float by reaction even when the leading end of the recording medium hangs down.

As described above, in accordance with the present invention, the floating of a recording medium from the platen can be suppressed to make the gap between the recording medium and recording means narrower, hence making it possible to achieve a high quality recording.

What is claimed is:

1. An ink jet recording apparatus for recording by deposition of ink droplets onto a recording medium by use of an ink jet recording head, comprising:

a platen arranged in a position facing the ink jet recording head;

a plurality of pinching portions, defined by pressure contact between rollers for nipping and conveying the recording medium in a conveying direction to the position of ink deposition onto the recording medium using the ink jet recording head; and a plurality of extrusions extending in the conveying direction of the recording medium with respect to said platen, and being arranged on said platen in a direction intersecting the conveying direction of the recording medium to support the reverse side of the recording medium, each of said pinching portions being positioned on a respective one of extended lines of said extrusions on an upstream side with respect to the conveying direction of the recording medium so that each of said extrusions is in one-to-one correspondence with a respective one of said pinching portions.

2. An ink jet recording apparatus according to claim 1, wherein said plurality of extrusions extend to different lengths in the upstream side with respect to the conveying direction of the recording medium.

3. An ink jet recording apparatus according to claim 2, wherein said plurality of extrusions of different lengths are arranged alternately.

4. An ink jet recording apparatus according to any one of claims 1 to 3, wherein in each of said pinching portions, the roller to be in contact with a recording surface of the recording medium is arranged to be deviated from the roller corresponding thereto more toward the downstream side with respect to the conveying direction of the recording medium, to nip and convey the recording medium while pressing the recording medium to said plurality of extrusions.

5. An ink jet recording apparatus according to claim 4, wherein said ink jet recording head discharges the ink by use of thermal energy.

6. An ink jet recording apparatus provided with a carrier roller unit having a drive roller and a follower roller arranged on the upstream side of a recording area, and a platen arranged on the downstream side of said carrier roller unit for supporting a recording medium in a position facing a recording head, comprising:

nipping portions of said carrier roller unit for nipping the recording medium by cooperation of the drive roller and the follower roller thereof, and non-nipping portions;

a plurality of ribs arranged on said platen, each of said ribs being positioned on a respective one of extended lines of said nipping portions in the conveying direction of the recording medium so that each of said ribs is in one-to-one correspondence with a respective one of said nipping portions, and each rib extending in the conveying direction of the recording medium, wherein in a standard position for conveying the recording medium, with one edge portion of the recording medium being aligned on one side, irrespective of the size of the recording medium, one of said plurality of ribs is arranged in a position inside the other edge of the recording medium by 1 mm to 10 mm.

7. An ink jet recording apparatus according to claim 6, wherein said plurality of ribs are of two kinds, longer ribs and shorter ribs, and said longer ribs and said shorter ribs are arranged alternately.

8. An ink jet recording apparatus according to claim 6, wherein the rotational center of said follower roller is deviated downstream of the rotational center of said drive roller to press the recording medium to said drive roller and said platen.

9. An ink jet recording apparatus according to any one of claims 6 to 8, wherein a sheet exhaust roller unit for exhausting the recording medium is arranged on the downstream side of the recording area, and said sheet exhaust roller unit comprises nipping portions for nipping the recording medium at least by a pair of rollers, and non-nipping portions, and each of said nipping portions of the exhaust roller unit is positioned substantially on extended lines of said ribs in the conveying direction of the recording medium.

10. An ink jet recording apparatus according to claim 9, wherein said sheet exhaust roller unit is arranged plural in number in two rows.

11. An ink jet recording apparatus according to claim 10, wherein among said two sheet exhaust roller units, the number of rollers in said sheet exhaust roller unit on the downstream side is smaller than that of said sheet exhaust roller unit on the upstream side.

12. An ink jet recording apparatus according to claim 9, wherein said sheet exhaust roller unit comprises sheet exhaust rollers and driven rollers, and the rotational centers of said driven rollers are deviated upstream of the rotational centers of said sheet exhaust rollers to press the recording medium to said driving rollers and said platen.

13. An ink jet recording apparatus according to claim 9, wherein each roller of said sheet exhaust roller unit is divided into plural rollers in a direction substantially orthogonal to the conveying direction of the recording medium.

14. An ink jet recording apparatus according to claim 6, wherein said recording head comprises an ink jet recording head for discharging ink by use of thermal energy.

15. An ink jet recording method for recording by deposition of ink droplets onto a recording medium by use of an ink jet recording head, comprising the steps of:

arranging a platen in a position facing the ink jet recording head;

nipping and conveying the recording medium, in a conveying direction, to the position of ink deposition onto the recording medium using the ink jet recording head, with a plurality of pinching portions, the pinching portions being defined by pressure contact between rollers; and supporting the reverse side of the recording medium with a plurality of extrusions extended in the conveying direction of the recording medium with respect to the platen, the plurality of extrusions being arranged in a direction intersecting the conveying direction of the recording medium, each of the pinching portions being positioned on a respective one of extended lines of the extrusions on an upstream side with respect to the conveying direction of the recording medium so that each of the extrusions is in one-to-one correspondence with a respective one of the pinching portions.

16. An ink jet recording method according to claim 15, wherein the plurality of extrusions extend to different lengths in the upstream side with respect to the conveying direction of the recording medium.

17. An ink jet recording method according to claim 16, wherein the plurality of extrusions of different lengths are arranged alternately.

18. An ink jet recording method according to any one of claims 15 to 17, wherein in each of the pinching portions, the roller to be in contact with a recording surface of the recording medium is arranged to be deviated from the roller corresponding thereto more toward the downstream side with respect to the conveying direction of the recording medium, to nip and convey the recording medium while pressing the recording medium to the plurality of extrusions.

19. An ink jet recording method according to claim 18, wherein the ink jet recording head discharges the ink by use of thermal energy.

* * * * *

UNITED STATES PATENT AND TRADEMARK OFFICE

CERTIFICATE OF CORRECTION

PATENT NO. : 6,659,603 B2
DATED : December 9, 2003
INVENTOR(S) : Kida et al.

It is certified that error appears in the above-identified patent and that said Letters Patent is hereby corrected as shown below:

Column 5,
Line 55, “and same” should read -- and the same --.

Column 7,
Line 23, “platen 17.” should read -- platen 19. --.
Line 48, “formed” should read -- is formed --.

Column 8,
Line 9, “effect” should read -- effects --.

Column 10,
Line 24, “and same” should read -- and the same --.

Column 12,
Line 23, “and,recesses” should read -- and recesses --.

Column 14,
Line 26, “driving” should read -- sheet exhaust --.

Signed and Sealed this

Third Day of August, 2004

JON W. DUDAS
*Acting Director of the United States Patent and Trademark Office*